United States Patent [19]

Ofner

[11] Patent Number: 4,995,966

[45] Date of Patent: Feb. 26, 1991

[54] SIFTER-SCREENING MACHINE FOR BULK MATERIAL

[75] Inventor: Maximilian Ofner, Leonberg, Fed. Rep. of Germany

[73] Assignee: Firma IBV, Leonberg, Fed. Rep. of Germany

[21] Appl. No.: 431,602

[22] Filed: Nov. 3, 1989

[30] Foreign Application Priority Data

Nov. 3, 1988 [DE] Fed. Rep. of Germany ..... 3837346

[51] Int. Cl.[5] ..... B07B 1/00

[52] U.S. Cl. ..... 209/240; 209/250; 209/305; 209/925; 406/109; 406/138; 406/151; 406/171; 406/174

[58] Field of Search ..... 209/240, 250, 255, 257, 209/305, 306, 925, 906, 932; 406/171, 175, 174, 109, 157, 138, 151

[56] References Cited

U.S. PATENT DOCUMENTS

| | | | |
|---|---|---|---|
| 1,037,223 | 9/1912 | Ellenburg et al. | 209/250 |
| 3,547,267 | 12/1970 | Sutherland | 209/240 |
| 3,996,015 | 12/1976 | Hutchings | 209/250 X |
| 4,042,503 | 8/1977 | Justus | 209/240 X |
| 4,205,931 | 6/1980 | Singer et al. | 406/175 X |
| 4,692,068 | 9/1987 | Hanrot et al. | 406/138 X |
| 4,810,270 | 3/1989 | Terry et al. | 209/305 X |

FOREIGN PATENT DOCUMENTS

| | | | |
|---|---|---|---|
| 243127 | 7/1960 | Australia | 406/171 |

*Primary Examiner*—Donald T. Hajec
*Attorney, Agent, or Firm*—Robert W. Becker & Associates

[57] ABSTRACT

A sifter-screening machine for loose material, especially flour, including an inlet for the material, downstream thereof a screen through which the material can be conveyed via an air stream, and downstream thereof an outlet for screened material. Disposed in the conveying route of the material, downstream of the screen, is a zone of reduced static pressure followed in the conveying direction by a conveying zone having an increasing cross-sectional configuration. The weight of the material just upstream of the outlet is at least nearly equal to the oppositely directed pressure of compressed air below an air-permeable element for supplying the material to the outlet.

15 Claims, 3 Drawing Sheets

SIFTER-SCREENING MACHINE FOR BULK MATERIAL

BACKGROUND OF THE INVENTION

The present invention relates to a sifter-screening machine for bulk or loose material, especially flour, including inlet means for the material, downstream thereof a screen through which the material can be conveyed via an air stream, and downstream thereof an outlet means for screened material.

With one known sifter-screening machine of this type, the material that is to be screened is drawn into the machine via an inlet that is embodied as a suction connection. The material passes into a sieve drum in which beaters rotate at high speed and throw the material and the air against the sieve drum. The air, with the loosened flour particles, passes the screen and is drawn off via the separator. The material is separated off in the separator and passes, after passing through the sieve drum, into an annular region that is delimited radially inwardly by the sieve drum and radially outwardly by the housing wall. The material passes out of this annular region into the separator, which tapers toward the bottom in a funnel-shaped manner. This funnel-shaped narrowing has the drawback that during discharge the loose material is increasingly compressed in conformity with the increasing cross-sectional narrowing of the outlet, and is hence compacted. This readily leads to blockage and to breakdown of the material stream, because as a result of the cross-sectional narrowing and the compaction of the loose material in the outlet, a bridge formation occurs that prevents a continuous discharge of the loose material.

It is an object of the present invention to embody a sifter-screening machine of the aforementioned general type in such a way that the loose material can be uniformly conveyed through the sifter-screening machine without the danger of breakdown of the material stream.

SUMMARY OF THE INVENTION

This object is realized for a sifter-screening machine of the aforementioned general type that is inventively characterized primarily disposing in the conveying route of the material, downstream of the screen, a zone of reduced static pressure followed in the conveying direction by a conveying zone having an increasing cross-sectional configuration; and by having the weight of the material just upstream of the outlet means at least nearly equal to the oppositely directed pressure of compressed air below air-permeable means for supplying the material to the outlet means.

With the inventive sifter-screening machine, the zone having the reduced static pressure is disposed in the conveying route of the loose material downstream of the screen. As a result, the material can be continuously conveyed in an optimum manner. In the zone adjoining this zone of reduced static pressure, the loose material can relax because this region widens in cross section in the conveying direction of the material. As a result, a bridging or arching in the material is reliably prevented, thus assuring a continuous transport of the material. So that the loose material can be satisfactorily conveyed to the outlet, it is acted upon by compressed air that holds the material nearly in suspension. For this purpose, compressed air is blown through the air-permeable feed or supply means, with the pressure of this compressed air being equal to the weight of the loose material. Thus, the loose material cannot be compacted upstream of the outlet means, so that in this critical zone it is easy to ensure that the material will be maintained in a loose state. With the inventive sifter-screening machine, the loose material can be continuously conveyed from the inlet means, through the sifter-screen machine, to the outlet means without the danger of breakdown of the material stream. This ensures a continuous supply of the respective loose material to the mechanism that ends in the sifter-screen machine.

Further features of the present invention can be seen from the claims, the specification, and the drawings.

BRIEF DESCRIPTION OF THE DRAWINGS

The present invention will be described in subsequently with the aid of one exemplary embodiment that is illustrated in the drawings, which show.

DESCRIPTION OF PREFERRED EMBODIMENTS

Figure 1:
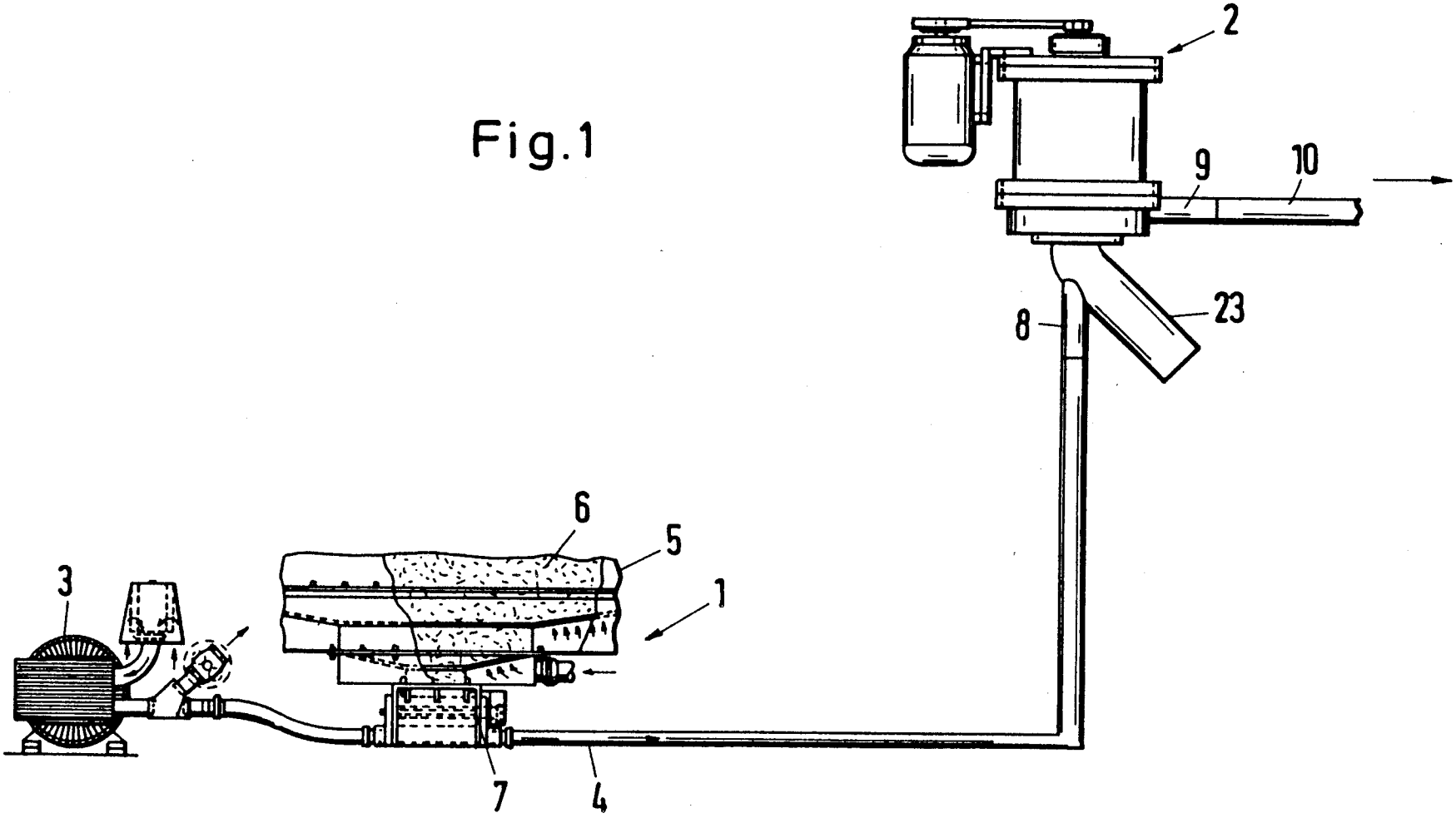
FIG. 1 a side view of an inventive sifter-screening machine that has been integrated into a conveying system, FIG. 2 an axial cross-sectional view of the sifter-screening machine of FIG. 1, FIG. 3 a view similar to that of FIG. 2, but to a smaller scale and with a discharge line.

FIG. 1 illustrates a conveying mechanism 1 with a sifter-screening machine 2 that is integrated into the conveying system. The conveying mechanism or conveying system is provided with an air compressor 3, to which is connected a conveying line 4. Disposed in the conveying line is a container 7 into which passes bulk or loose material 6, preferably flour or other powdery material, that is supplied from a storage bin 5. The material 6 is carried along in the line 4 by the air flow that is generated by the air compressor 3.

The line 4 is connected, and is expediently plug connected, with a feed line 8, preferably a feed pipe, of the sifter-screening machine 2. The material 6 leaves the feed line 8 and enters the sifter-screening machine 2, where it is sifted or screened, and then passes via an outlet means 9, preferably a discharge pipe, into a line 10 of the conveying mechanism 1 that is connected therewith. Via the line 10, the screened material is conveyed to a further (not illustrated) processing station, for example a scale.

The sifter-screening machine 2 has a housing 11, 12, 13, including a cup-shaped lower portion 11 of the housing, a cylindrical wall 12 of the housing, and an upper portion 13 of the housing with a bearing cover **13*a*. Mounted in the upper portion 13 of the housing and in the bearing cover 13*a* is a drive shaft 14 that is rotatably driven by a motor 15 via a pinion 16 and an intermediate shaft 16*a*. The motor is secured to the upper portion 13 via a support bracket 17**.

The cup-shaped lower portion 11 of the housing has a central passage 18 that is delimited by an annular wall 19 and to which is connected from the outside an outlet pipe 23, the inner diameter of which in the connection region is the same as the diameter of the passage 18. The annular wall is concentric to the higher outer wall 20 of the lower portion 11 of the housing. Secured to the base 21 of the lower portion 11 is an annular disk-like member 22 via which the outlet pipe 23 that projects downwardly out of the housing is held on the lower portion 11 of the housing. The outlet pipe 23 extends outwardly at an angle and is provided with an opening 24 through which the connecting pipe 8 can project outwardly in a sealed manner. In a central region, this pipe is surrounded by a short, upper, bent portion 25 of the outlet pipe 23 that is spaced from the connecting pipe. In the illustrated embodiment, the outlet pipe 23 is inclined at an angle of approximately 45° relative to the connecting pipe 8, with the lower end 26 of the outlet pipe being closed off by a snap-type closure 27 (indicated only schematically). Material retained in the housing 11 to 13 by a screen or filter 28 is collected in the outlet pipe 23 and can be emptied therefrom if necessary.

Seated on the lower portion 11 of the housing is an annular fluidized bed 29 that, via circumferential edge portions 30, 31 that project radially outwardly, rests upon a shoulder 32 of the outer wall 20 and upon the end face 33 of the annular wall 19. The edge portion 31 is secured between the end face 33 of the annular wall 19 and a ring 34. The other edge portion 30 is secured between the shoulder 32 and a further annular member 35 that concentrically surrounds the ring 34.

The annular member 35 is provided with an outer surface 36 that in the vicinity of the end face of the outer wall 20 of the lower portion 11 of the housing has a radially outwardly directed, circumferential shoulder surface 36*a* upon which the lower end of the cylindrical housing portion 12 rests. The radial width of the shoulder surface 36*a* preferably corresponds to the thickness of the cylindrical housing portion 12. In the region above the shoulder surface 36*a*, the annular member 35 rests against the inner wall of the housing portion 12, which is thereby effectively supported in the lower region.

The upper end 37 of the housing portion 12 extends into an annular shoulder 38 on the underside of the upper portion 13 of the housing. The housing portion 12 is radially secured and held in the annular shoulders 36*a* and 37 via pressing rings 39, 40 that are screwed or otherwise secured on an annular flange 41 of the lower portion 11 of the housing and on the cover rim 42 respectively The annular member 35 preferably has an approximately triangular cross-sectional configuration, the tip 35*a* of which is directed radially inwardly. As a result, at the level of the triangle tip 35*a*, the annular member 35 has its smallest inside diameter and from there widens both upwardly and downwardly. In this way, in the region above the circumferential triangle tip 35*a* a downwardly tapering annular space 43 is formed, and in the region below the triangle tip a downwardly widening annular space 44 is formed. The upper annular space 43 has a slightly greater height than does the lower annular space 44. As a consequence of the narrowed portion 45 that is formed between these spaces 43, 44, the annular member 35 forms a type of injector nozzle, as will be described subsequently. The ring 34 is disposed next to the lower annular space 44.

A widened end portion 14*a* of the drive shaft 14 extends into the upper end 50*a* of a tubular carrier member 50 of an annular brush or wiper 51 of the sifter-screen machine 2. The free end 57 of the connecting pipe 8 extends into the lower end 56 of the carrier member 50 with play. The carrier member 50 is provided with a plurality of openings 47, 48 that are embodied as elongated axial slots and are provided for the material that is to be screened.

Figure 2:
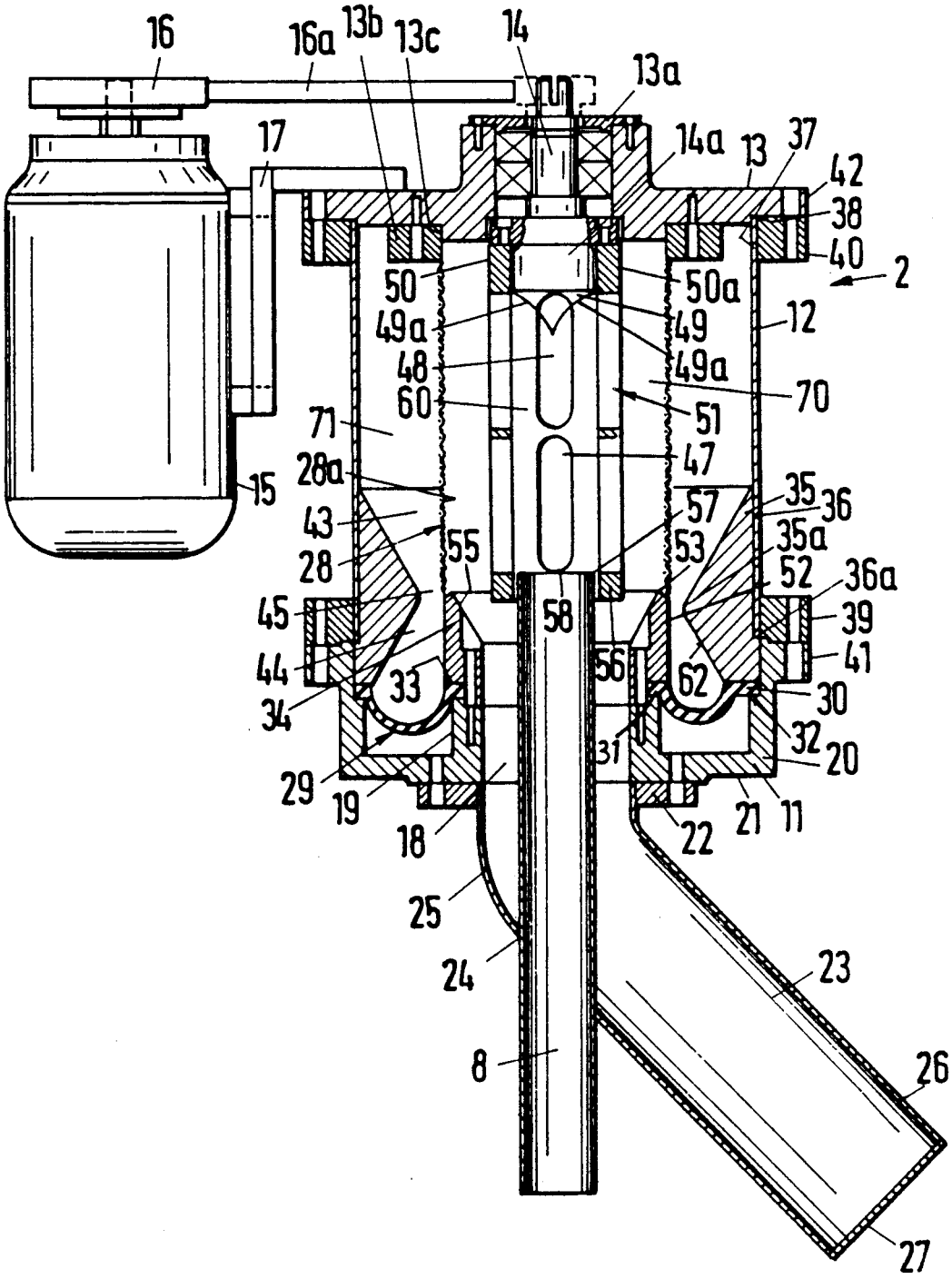

So that the carrier member 50 has an adequate strength despite the presence of the openings 47, 48, these openings are preferably disposed one above the other in rows that are peripherally spaced from one another. Each of the openings 47, 48 extends over nearly half the height of the carrier member 50. At the level of the upper half of the upper opening 48, the lower end 14*a* of the drive shaft 14 is provided with a downwardly projecting guide or deflection portion 49 for the material that is being conveyed; this guide portion 49 tapers downwardly in the manner of a cone. As shown in FIG. 2, the surface 49*a* of the guide portion 49 has a concavely curved cross-sectional configuration.

Secured to the outer side of the carrier member 50 are (non-illustrated) strips of bristles having tufts of bristles, the free ends of which extend nearly to the cylindrical screen 28. This screen preferably comprises a perforated metal sheet. The upper end 28*a* of the screen 28 is preferably held radially against a shoulder 13*c* of the upper portion 13 of the housing via a clamping ring 13*b* that is secured to the housing 13.

The lower end of the screen 28 is secured to the outer surface 52 of the ring 34, which is secured to the lower portion of the housing. The upper edge 53 of the ring 34 is disposed approximately at the level of the narrowed portion 45. Adjoining this edge 3 on the radially inner side is a conical surface 55 that extends downwardly at an angle over approximately half the height of the ring. The conical surface 55 extends upwardly to beyond the lower end 56 of the carrier member 50. Screened out particles can easily slide downwardly on the conical surface 55 and into the outlet pipe 23.

The upper end 57 of the connecting pipe 8 is disposed at the level of the lower edge 58 of the lower elongated slot 47.

Between its edge portions 30, 31, the fluidized bed 29 has a curved cross-sectional configuration in the form of part of a circle; the inside of this fluidized bed leads directly into the cylindrical outer surface 52 of the ring 34 and the lower inner wall 62 of the annular member 35 that is in the form of a conical surface. In the fluidized bed 29, the screened material is collected for further transport via the outlet pipe 9 (FIG. 1) and the line 10.

For the purpose of screening, the material being conveyed, especially flour, is introduced via the storage bin 5 and the container 7 into the conveying line 4. There, the material is conveyed via the compressed air stream produced by the air compressor 3 to the sifter-screening machine 2, in which the material is screened and is then further conveyed in a conveying circuit of the conveying mechanism. Instead of this transport using pressure, a suction stream can also be produced in the conveying mechanism 1 for transporting the material via a vacuum. In such a case, the appropriate pump is disposed downstream of the sifter-screening machine 2 in the direction of flow of the material.

From the line 4, the flour that is to be screened passes via the connecting pipe 8 into the brush mechanism 51. The material thus enters the sifter-screening machine 2 from below in a vertical direction, i.e. in the axial direction of the brush mechanism of the sifter-screening machine. Via the openings 47, 48 of the carrier member 50, the material enters a brush chamber 70 between the screen 28 and the carrier member 50 in which the bristles rotate and in which the material that is to be screened is combed. Since the guide portion 49 ends in a point, and its surface has a concavely curved cross-sectional configuration, the conveyed stream that is directed vertically upwardly from below is optimally guided or deflected in an approximately horizontal direction and is split up, so that the deflected conveyed stream can satisfactorily flow through the openings 47, 48.

Due to the rotation of the drive shaft 14 and the brush 51, and the construction and shape of the brush chamber 70, the conveyed stream is guided in the horizontal direction, so that the material contained in the deflected conveyed stream is pressed through the cylindrical screen 28 and is thereby screened or sifted. Due to the pressure in the conveying line 4 and in the feed channel 60 of the brush 51, the screened material cannot flow back into the feed line. Rather, the material is deflected downwardly into the outlet pipe 23 along the inner wall 28*a* of the screen due to its own weight and the rotational movement of the brush 51. The material can be removed from the outlet pipe when necessary, for which purpose it is merely necessary to open the (not illustrated) snap-type closure 27. The outlet pipe is subsequently again closed off by the snap-type closure, thereby avoiding a pressure loss in the conveying system.

After the brushes in the brush chamber 70, and after passing the screen 28, the material passes into the radially outwardly adjoining screen chamber 71 that is disposed between the screen 28 and the housing portion 12. In the screen chamber 71, the conveyed material, reinforced by the compressed air stream, falls from the upper annular space 43, via the narrowed portion 45, into the downwardly adjoining annular space 44, and hence into the fluidized bed 29, which is disposed at the lower end of the screen surface or of the cylindrical wall 12 of the housing 11, 12, 13. The fluidized bed 29 is comprised of air-permeable material, such as sintered polyethylene. The fluidized bed is aerated from below with compressed air. The air that percolates upwardly through the fluidized bed enhances the return into the conveying stream of material that collects in the fluidized bed.

Figure 3:
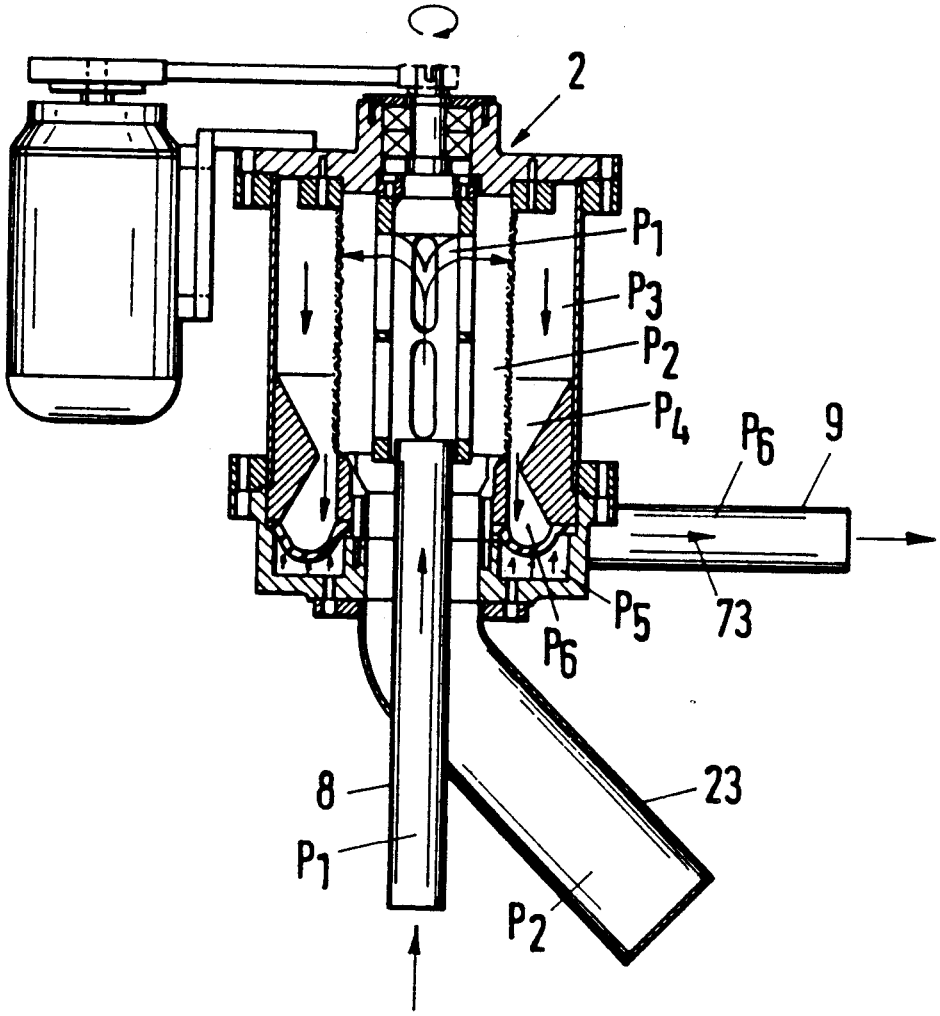

Due to the shape of the fluidized bed 29 and the cross-sectional configuration of the injector nozzle 35 disposed thereabove, the conveyed, material cannot pass back into the screen chamber 71. The injector nozzle 35 leads to an increase of the flow velocity and to a reduction of the static pressure, thereby facilitating transport of the material. Due to the conveying pressure that presses the conveyed material through the injector nozzle 35, the material in the fluidized bed 29 is forced to flow in the direction of flow (arrow 73 in FIG. 3) into the outlet or discharge pipe 9, i.e. in the direction of the lower pressure.

To explain the conveying pressure (FIG. 3), the entire conveying system is regarded as static, i.e. the entire pressure distribution in the sifter-screening machine 2 is viewed at a given moment and is thus seen as static. The conveying stream is thus disregarded.

With regard to the pressure distribution in the sifter-screening machine, the pressure P1 that exists in the connecting pipe 8 and in the carrier member 50 is greater than the pressure P2 in the brush chamber 70. The pressure P2, in turn, is greater than the pressure P3 in the screen chamber 71, which is greater than the pressure P4 in the annular space 43. The pressure P4 is greater than the pressure P6 in the discharge pipe 9. Thus, the following equation applies: P1>P2>P3>P4>P6.

The pressure P5 below the fluidized bed 29 is equal to the weight of the conveyed material. As a result, the conveyed material in the fluidized bed 29 can just about be kept suspended, so that it can easily be conveyed to the discharge pipe 9.

With the described sifter-screening machine 2, it is possible to achieve within the conveying system 1 a protective screening of the conveyed material, especially flour, as is increasingly being required by bakeries and the like.

After being discharged from the discharge pipe 9 of the sifter-screening machine 2, the screened material passes into a further conveying line 10 of the conveying mechanism 1 in which it is further conveyed in the conveying stream. For example, the screened material then passes to a scale or a similar mechanism in which the material or flour can be further processed.

The present invention is, of course, in no way restricted to the specific disclosure of the specification and drawings, but also encompasses any modifications within the scope of the appended claims.

What I claim is:

1. In a sifter-screening machine for loose material, including inlet means for said material, downstream thereof a screen through which said material is conveyed along a conveying route via an air stream, and downstream thereof an outlet means for screened material, the improvement wherein:

disposed in the conveying route of said material, downstream of said screen, is a zone of reduced static pressure followed in the conveying direction by a conveying zone having an increasing cross-sectional configuration;

disposed downstream of said conveying zone is an air-permeable means for supplying said material to said outlet means with a supply of compressed air being delivered below said air-permeable means; and the weight of said material just upstream of said outlet means is at least nearly equal to the oppositely directed pressure of said compressed air below said air-permeable supply means.

2. A machine according to claim 1, which includes an injector nozzle for forming said zone of reduced static pressure.

3. A machine according to claim 2, which includes an annular member that forms said injector nozzle.

4. A machine according to claim 3, in which said annular member has an approximately triangular cross-sectional configuration with a radially inwardly directed triangle tip; disposed above and below a horizontal plane that contains said triangle tip are respective funnel-shaped annular spaces that widen counter to and in the conveying direction respectively, with that annular space that widens in the conveying direction forming said zone that has an increasing cross-sectional configuration.

5. A machine according to claim 4, which includes a housing having a lower portion on which is seated a ring that has an upper edge, with said zone of reduced static pressure being provided in the vicinity of said triangle tip and being formed by a narrowed portion of said injector nozzle that is disposed at the level of said upper edge of said ring, into which opens an outlet pipe that is adapted to be closed off by removal means.

6. A machine according to claim 5, in which said air-permeable supply means is embodied as a fluidized bed for said loose material.

7. A machine according to claim 6, in which said fluidized bed is made of sintered polyethylene and is embodied as a circumferential channel having an approximately semicircular cross-sectional configuration.

8. A machine according to claim 5, in which said outlet means is disposed on said housing at the level of said supply means.

9. A machine according to claim 8, in which said outlet means extends horizontally.

10. A machine according to claim 5, in which said screen is part of a screen mechanism that includes a rotatably driven brush that has a tubular carrier member for strips of bristles, with said carrier member being connected to a motor-driven drive shaft and being provided with axially extending elongated slots for the passage of a stream of said material.

11. A machine according to claim 10, which has a vertically extending axis.

12. A machine according to claim 10, in which said drive shaft is provided with a guide member that extends into an upper end of said carrier member, with said guide member having a surface with a concavely curved cross-sectional configuration for deflecting said loose material outwardly through at least some of said elongated slots.

13. A machine according to claim 12, in which said brush has bristles that rotate in a brush chamber that is surrounded by said screen and a radially outwardly adjoining screen chamber that is delimited radially outwardly by a wall of said housing.

14. A machine according to claim 13, in which a first pressure, which exists in said inlet means and in s aid carrier member, is greater than a second pressure that exists in said brush chamber and that is greater than a third pressure in said screen chamber, with said third pressure being greater than a fourth pressure, which exists ins aid annular space that widens counter to said conveying direction and which is greater than a fifth pressure in said outlet means.

15. A machine according to claim 12, in which said carrier member has a lower end into which projects said inlet means, which has an axis that is aligned with an axis of said drive shaft.

* * * * *